US005125645A

United States Patent [19]

Eberle

[11] Patent Number: 5,125,645

[45] Date of Patent: Jun. 30, 1992

[54] APPARATUS FOR THE DELIVERY OF PRINTING PRODUCTS

[75] Inventor: Jurg Eberle, Hinwil, Switzerland

[73] Assignee: Ferag AG, Hinwil, Switzerland

[21] Appl. No.: 549,566

[22] Filed: Jul. 9, 1990

[30] Foreign Application Priority Data

Jul. 18, 1989 [CH] Switzerland ..... 2680/89

[51] Int. Cl.[5] ..... B65H 29/40

[52] U.S. Cl. ..... 271/315; 271/216; 271/224

[58] Field of Search ..... 271/187, 315, 216, 224, 271/307, 308

[56] References Cited

U.S. PATENT DOCUMENTS 2,172,364 9/1939 De Manna ..... 271/315

4,434,979 3/1984 Kobler ..... 271/187 X

*Primary Examiner*—Richard A. Schacher

*Attorney, Agent, or Firm*—Fleit, Jacobson, Cohn, Price, Holman & Stern

[57] ABSTRACT

The ejecting arrangement has two ejecting wheels which are designed in saw-toothed form on their circumference. The ejecting wheels can be swiveled out of a position in which they are turned by half a tooth pitch with respect to each other into a position in which the stops of the two ejecting wheels are mutually aligned. If the ejecting wheels are offset with respect to each other by half a tooth pitch, each printing product inserted into a pocket of the paddle wheel runs onto a stop and is ejected by the latter from the pocket due to the different speeds of the paddle wheel and of the ejecting wheels and is deposited in imbricated formation onto the delivery conveyor. If, on the other hand, the stops of the two ejecting wheels are mutually aligned, the printing products of two successively occupied pockets in each case make contact with a stop, as a result of which the two printing products are ejected from the pockets mutually aligned with their fold. Consequently, an imbricated formation is formed, in which two printing products congruently lying one on top of the other in each case rest in an imbricated manner on the preceding printing product.

11 Claims, 8 Drawing Sheets

APPARATUS FOR THE DELIVERY OF PRINTING PRODUCTS

Figure 1:
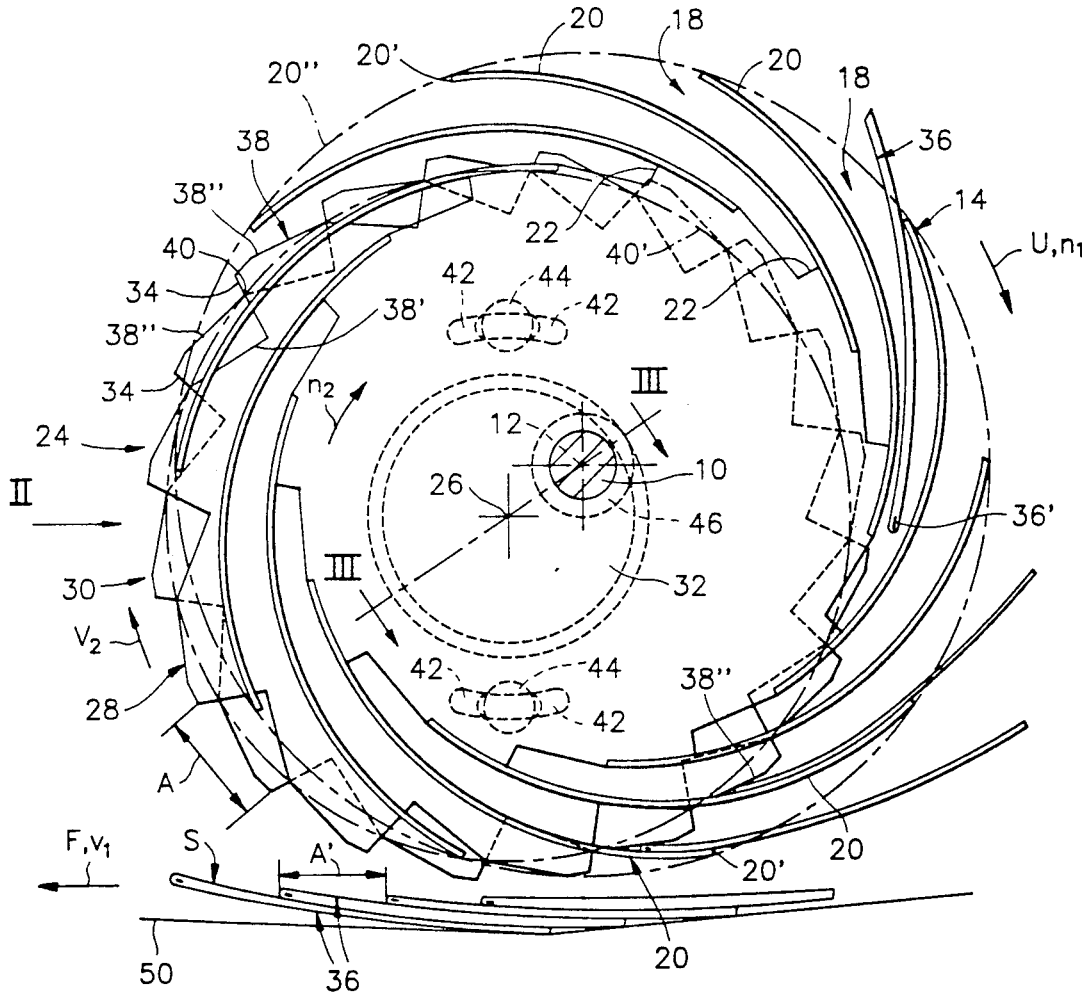

The present invention relates to an apparatus for the delivery of printing products, in particular folded printing products, in a regular imbricated formation upon a belt conveyor. European Patent Specification 0,059,873 or the corresponding U.S. Pat. No. 4,434,979 discloses such an apparatus. The said apparatus has an ejecting wheel, which is designed in the form of a disk ring, is mounted eccentrically in relation to the paddle wheel and encompasses the shaft of the paddle wheel. Twice as many stops as the paddle wheel has pockets are provided, distributed around the circumference of the ejecting wheel. The ejecting wheel is driven at half-speed in relation to the paddle wheel, so that each pocket is in each case assigned a stop for ejecting the printing products inserted into the pockets. A delivery conveyor, which is driven at a speed which corresponds to the circumferential speed of the stops, is provided underneath the paddle wheel. Due to the relative speed between the stops and the pockets, each printing product inserted into a pocket of the paddle wheel initially runs onto the respective stop and is ejected from the pocket during the course of the further rotation of the paddle wheel and of the ejecting wheel and is deposited at a spacing which corresponds to the spacing between the stops, in imbricated formation onto the delivery conveyor.

U.S. Pat. No. 2,172,364 discloses a further apparatus for the delivery of printing products from a rotatably driven paddle wheel. The ejecting wheel of this apparatus is rotatably mounted between the shaft and the pockets of the paddle wheel and is driven at the same speed and in the same direction of rotation as the paddle wheel. The number of stops of the ejecting wheel corresponds to the number of pockets of the paddle wheel. Each printing product inserted into a pocket runs onto a stop and, due to the lower circumferential speed of the ejectly wheel in relation to the paddle wheel, is ejected from the pocket and deposited in imbricated formation onto a delivery conveyor arranged underneath the paddle wheel.

For the further processing of the printing products, it may be of advantage if, in an imbricated formation, in each case at least two printing products, congruently one on top of the other, can rest in an imbricated manner on the preceding printing products. European Laid-Open Patent Application 0,179,992 discloses an apparatus for forming stacks from signature sheets ejected from a paddle wheel and conveying this stack away in imbricated formation. The said apparatus has a fixed-in-place stop, which the signature sheets hit and, seen in the direction of rotation of the paddle wheel, are thus brought to a standstill. The signature sheets thus ejected from the paddles of the paddle wheel float in free fall onto a retaining device or the signature sheets already deposited thereupon. The retaining device in each case holds the lowermost signature sheet of a stack back from being taken along by friction by the previously completed stack to be conveyed away. The delivery conveyor and the paddle wheel are synchronized in such a way that the delivery conveyor in each case conveys a stack away as soon as it has the desired number of signature sheets. In the case of this known apparatus, the signature sheets are retarded considerably at the stop, which can result in damage to the said sheets.

It is an object of the present invention to provide an apparatus of the generic type by means of which the optional formation of different imbricated formations is possible while treating the printing products in a gentle way.

These and other objects are achieved by providing the features described below.

By varying the number of effectively ejecting stops, it is then possible, according to choice, to assign a stop to each pocket of the paddle wheel or to assign a common stop respectively to two or more pockets. If a stop acts on the printing product in a single pocket, the printing products are delivered individually, the distance between the leading edges of the printing products corresponding to the distance between the stops By changing the number of effectively ejecting stops, it is then made possible for the printing products arranged in two or more pockets to run onto a common stop and to be ejected by the latter from the paddle wheel one on top of the other. The desired formation is thus directly formed upon delivery of the printing products without the aid of means provided outside the paddle wheel and the ejecting arrangement.

In a particularly preferred and simple embodiment, the number of effectively ejecting stops can be halved. This makes it possible to switch over from delivery in an imbricated formation in which each printing product is ejected individually from the paddle wheel, to an imbricated formation in which two printing products are respectively ejected jointly and one on top of the other, without changing the relative speed between the paddle wheel and the ejecting apparatus.

In a particularly preferred embodiment of the apparatus according to the invention, the ejecting arrangement has two ejecting wheels, which each have the same number of stops. By mutually aligning the stops of the two ejecting wheels or by turning the two stop wheels in opposite directions by half a division of the stops, the number of effectively ejecting stops can be halved or doubled.

In the case of a further, likewise particularly preferred embodiment, each printing product is retarded by a first ejecting wheel and the respective paddle in the same optimum way and led to the stops of a second ejecting wheel. Moreover, according to this embodiment, it is possible to retrofit known apparatus, for example an apparatus according to European Patent Specification No. 059,873, or the U.S. Pat. No. 4,434,979, without changing the paddle wheel or the ejecting wheel.

In a further preferred embodiment of the apparatus according to the invention, a delivery conveyor is provided underneath the paddle wheel. The printing products are ejected from the paddle wheel essentially at the same speed, seen in the conveying direction of the delivery conveyor, and deposited onto the delivery conveyor as they are transported away by the latter. Consequently, there is virtually no relative speed between the belt conveyor and the printing products to be deposited thereupon, which results in the formation of a particularly precise imbricated formation.

Further preferred embodiments are described below.

Figure 2:
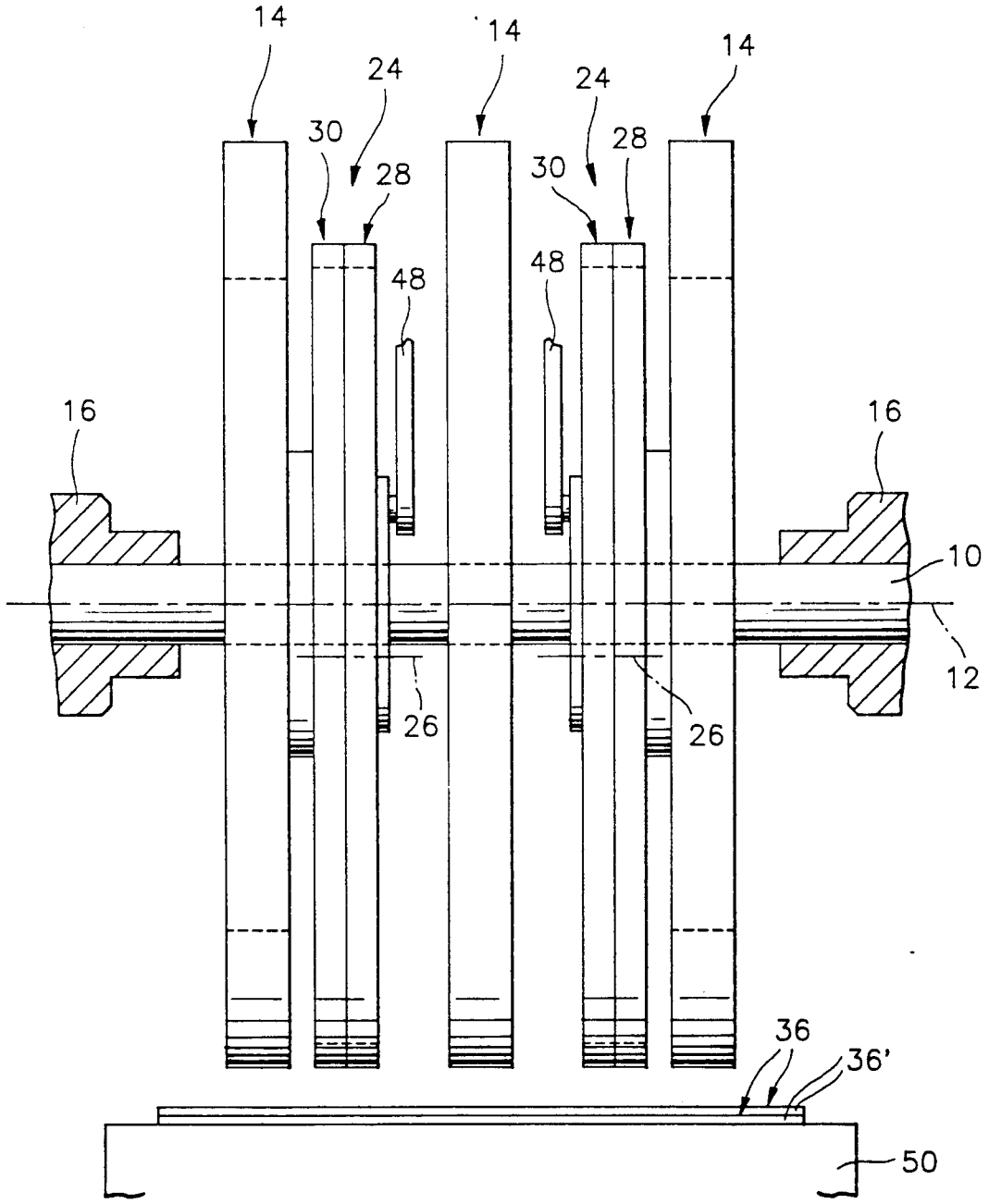
Figure 3:
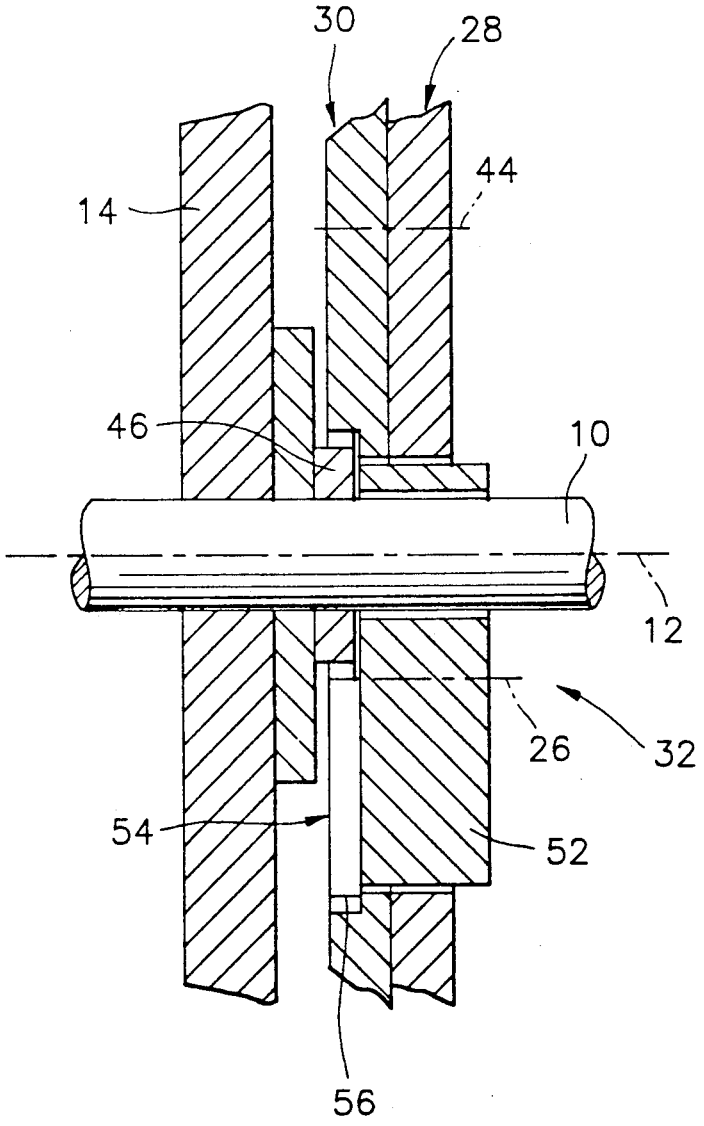
Figure 4:
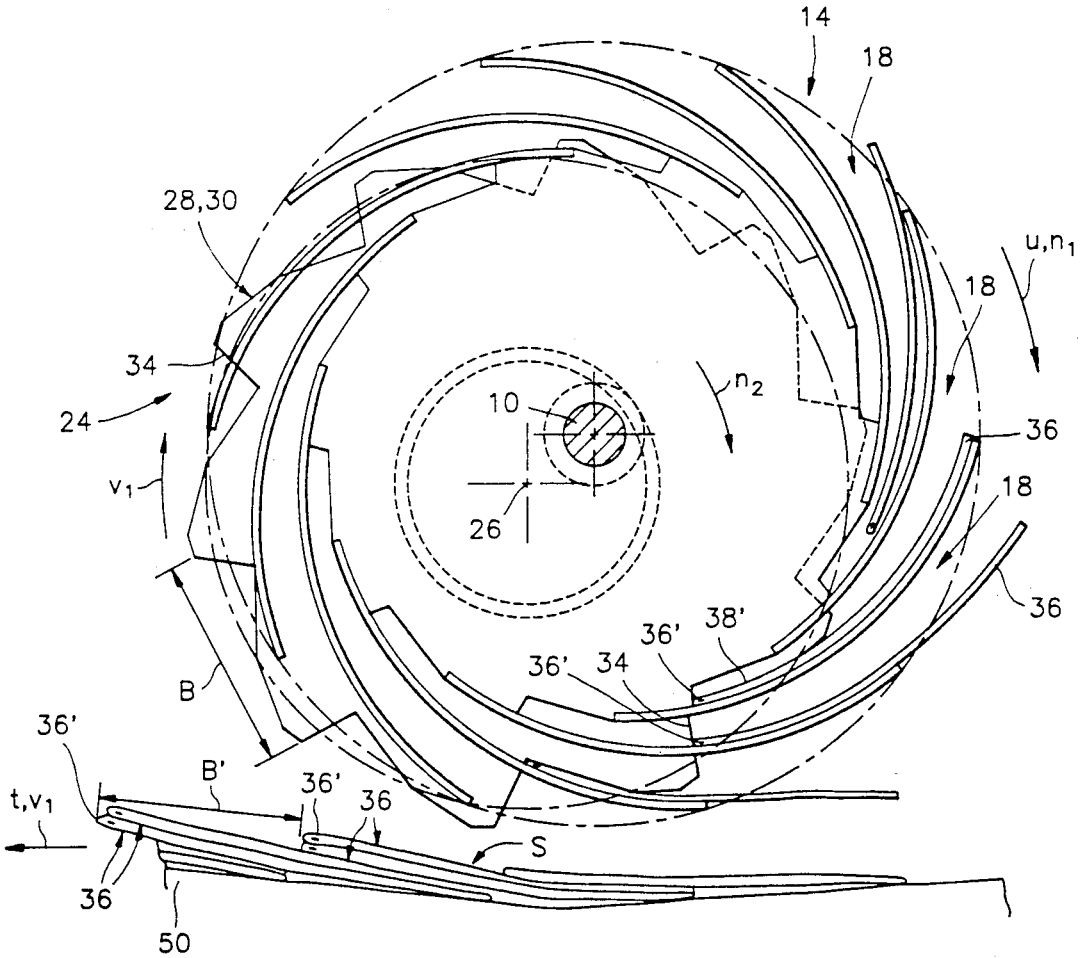
Figure 5:
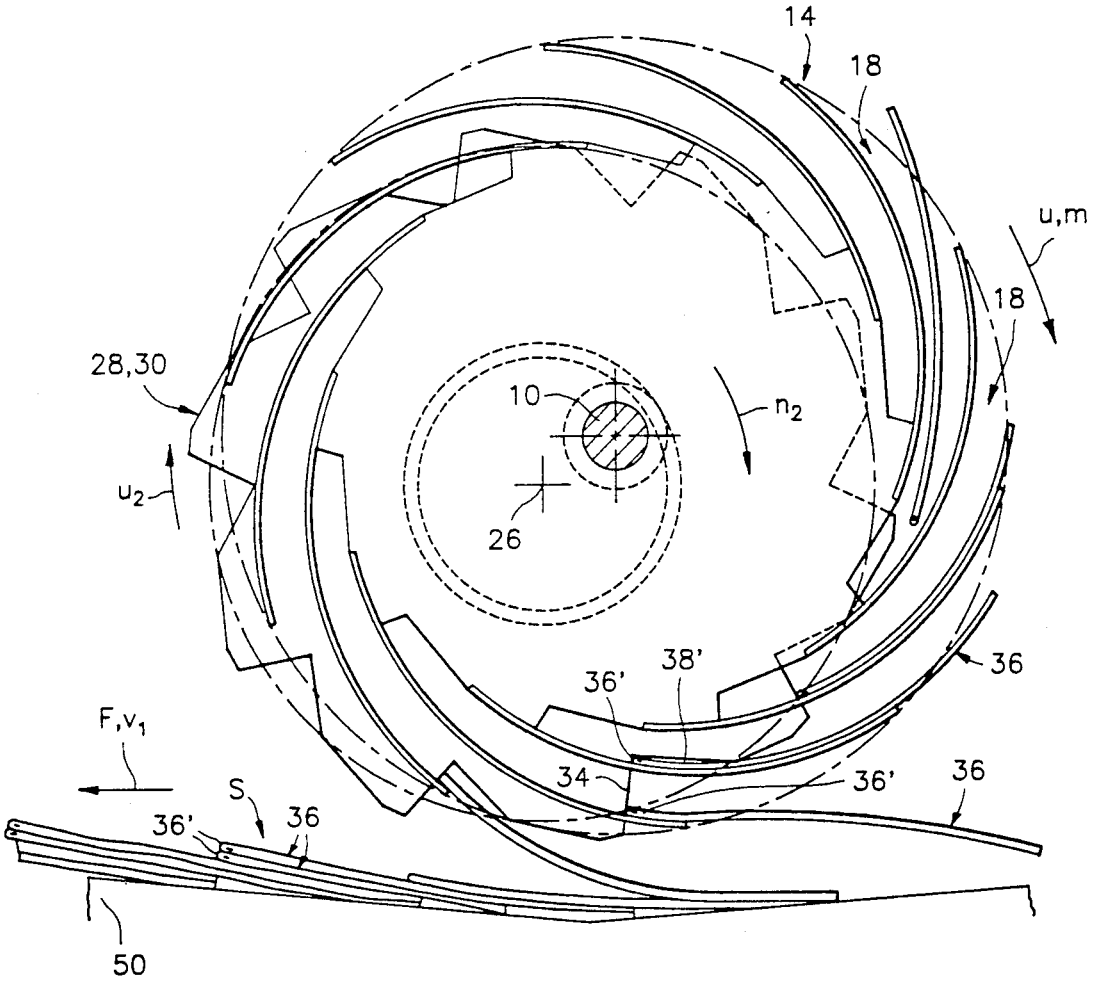
Figure 6:
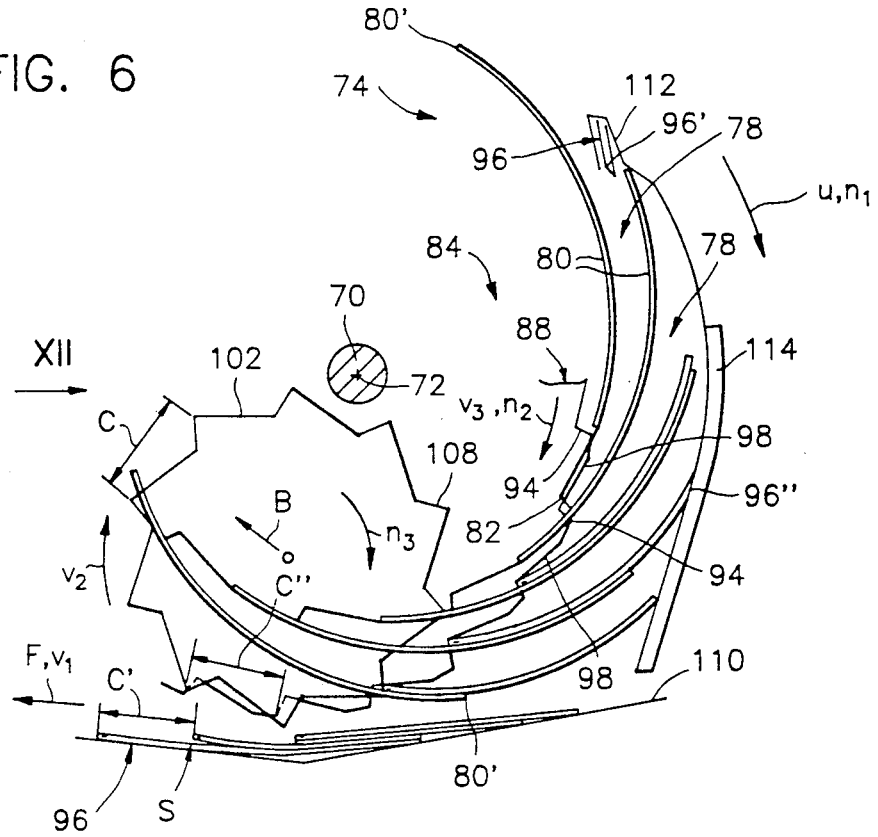
Figure 10:
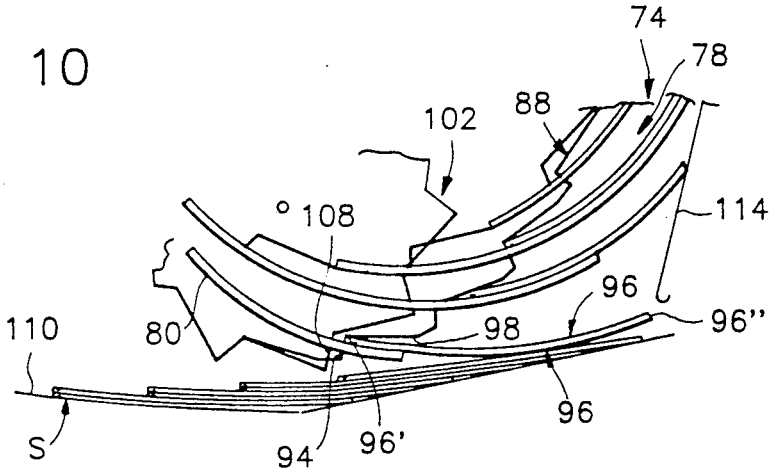
Figure 11:
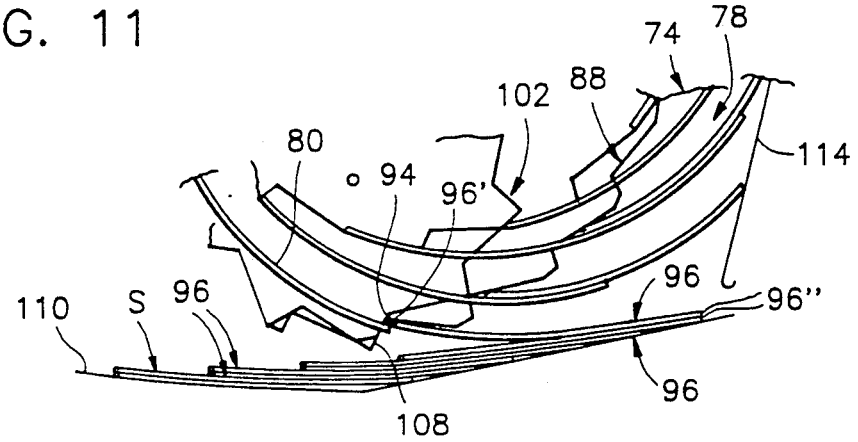
Figure 12:
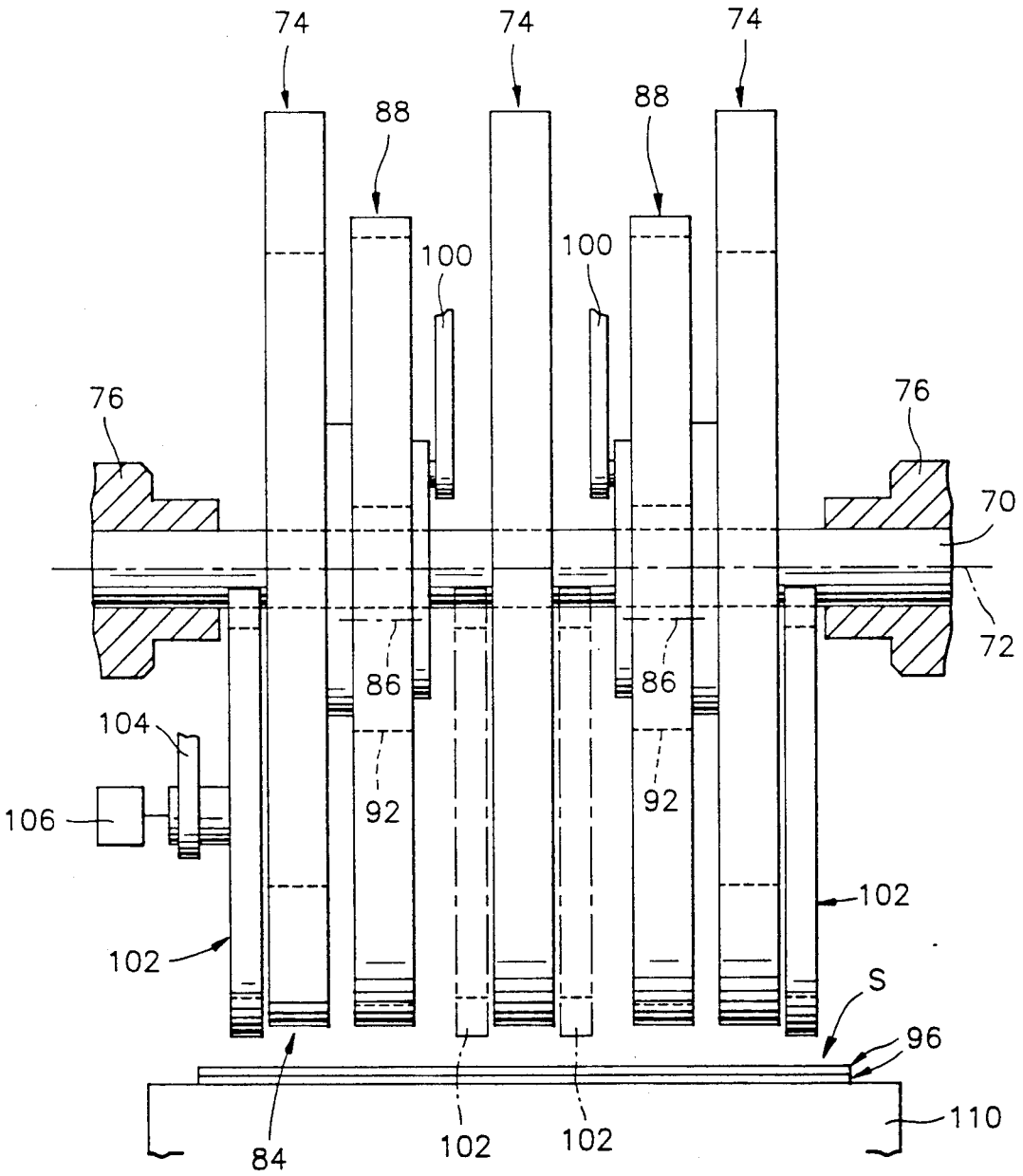

The invention is now explained in more detail with reference to two embodiments represented in the purely diagrammatic drawing, in which:

FIG. 1 shows a view of a first embodiment of the delivery apparatus,

FIG. 2 shows a side view of the delivery apparatus in the direction of the arrow II of FIG. 1, FIG. 3 shows in an enlarged representation a section along the line III—III of FIG. 1, FIGS. 4 and 5 show in side view the apparatus according to FIG. 1 in the depositing of two printing products one on top of the other at various phases of a working cycle, FIGS. 6 to 11 show a simplified view of a further embodiment of the delivery apparatus at six different points in time of an operating cycle, and FIG. 12 shows a side view of the delivery apparatus in the direction of the arrow XII of FIG. 6.

The apparatus represented in FIGS. 1 and 2 has three paddle wheels 14 of a printing machine, which wheels are seated in a rotationally fixed manner on a common shaft 10 and are spaced apart in the direction of the axis 12 of the shaft 10. The shaft 10 is mounted freely rotatably on fixed-in-place bearings 16 and driven in the direction of rotation U at the speed n1. Each paddle wheel has ten pockets 18, which are open rearward, seen in arrow direction U, separated from one another by paddles 20 and closed off in their leading region by a base 22. The orbit of the trailing free ends 20' of the paddles 20 is indicated by dot-dashed lines and is denoted by 20" (FIG. 1).

An ejecting arrangement 24 is provided in each case in the region between two paddle wheels 14. Said arrangement has two ejecting wheels 28, 30, which are driven rotatingly in arrow direction U about an axis of rotation 26, indicated by dot-dashed lines. The speed n2 of the ejecting wheels 28, 30 is half that of the speed n1 of the paddle wheels 14. The ejecting wheels 28, 30 are designed in the form of a disk ring, are mounted freely rotatably on a common bearing arrangement 32 and encompass the shaft 10. The bearing arrangement 32 is explained in more detail further below in conjunction with FIG. 3.

The two ejecting wheels 28, 30 are of the same size and of saw-toothed design around their circumference. Seen in the direction of rotation U, the trailing steep flanks form stops 34 for the printing products 36, inserted into the pockets 18, for ejecting the said products from the paddle wheel 14. Each ejecting wheel 28, 30 has ten stops 34 evenly distributed around the circumference, the two ejecting wheels 28, 30 being turned in opposite directions by half a division of the stops 34. The ejecting arrangement 24 thus has twenty stops 34. Seen in arrow direction U, the leading flat flanks 38 have in their central region a kink 40, the respectively preceding flank part 38', which is the inner flank part seen in radial direction, forming a greater angle with the circular path of movement 40', indicated by dot-dashed lines, of the kinks 40 than the trailing flank part 38" does.

Both ejecting wheels 28, 30 have two diametrically opposite slot-shaped passages 42, running centrally with respect to the axis of rotation 26. A bolt-shaped fastening element 44 for releasable clamping of the two ejecting wheels 28, 30 against each other runs through the mutually corresponding passages 42 of the two ejecting wheels 28, 30. The fastening element 44 is, for example, a screw-nut connection.

Also seated in a rotationally fixed manner on the shaft 10 for each ejecting arrangement 24 is a pinion 46, indicated by dot-dashed lines, which meshes with a corresponding internal toothing (not shown in FIGS. 1 and 2) on the ejecting wheel 30. In FIG. 2, a linkage is denoted by 48, by means of which the swivel position of the bearing arrangement 32 for the ejecting wheels 28, 30 can be set.

A delivery conveyor 50, for example, a belt conveyor, the conveying direction of which is denoted by F, is provided underneath the paddle wheel 14. The said conveying direction is in the same direction as the direction of rotation U of the paddle wheel 14 and of the ejecting wheels 28, 30. The conveying speed v1 corresponds to the circumferential speed v2 of the ejecting wheels 28, 30. The printing products 36 inserted into the pockets 18 of the paddle wheel with their leading fold 36', seen in arrow direction U, are pushed by means of the ejecting arrangement 24 out of he pockets 18 and deposited in imbricated formation S onto the delivery conveyor 50, each printing product 36 resting in an imbricated manner on the preceding printing product 36, seen in conveying direction F. The distance between two stops 34 is indicated in FIG. 1 by the double-headed arrow A and the distance between the folds 36' of the printing products 36 delivered in imbricated formation S is denoted by A'. Since the speeds v1 and v2 are equal, the distance A corresponds to the distance A'.

FIG. 3 shows enlarged the bearing arrangement 32 for the two ejecting wheels 28, 30 in a section along the line III—III of FIG. 1. The paddle wheel 14 and the pinion 46 are seated in a rotationally fixed manner on the shaft 10. A bearing element 52 in the form of a circular disk is mounted eccentrically freely rotatably on the side of the pinion 46 facing away from the paddle wheel 14. The bearing element is connected to the linkage 48 (cf. FIG. 2) and can be set in its swivel position about the axis 12. The two ejecting wheels 28, 30 are seated on the bearing element 52 and are freely rotatable in relation to the latter about the axis of rotation 26. The ejecting wheel 30 adjacent to the pinion 46 has on the side facing the pinion 46 a round recess 54, which is central to the axis of rotation 26 and has an internal toothing 56. The said toothing meshes with the corresponding toothing of the pinion 46. The rotational movement of the ejecting wheel 30 is transferred to the ejecting wheel 28 by the fastening element 44, in this figure only indicated by dot-dashed lines. The gear reduction between pinion 36 and ejecting wheels 28, 30 is designed in such a way that the two ejecting wheels 28, 30 are driven at half-speed in relation to the shaft 10.

By loosening the fastening elements 44 (cf. FIG. 1), the two ejecting wheels 28, 30 can be turned in opposite directions by half a tooth pitch of an ejecting wheel 28 and 30, respectively. As shown in FIGS. 4 and 5, the stops 34 of the two ejecting wheels 28, 30 are thereby mutually aligned. In this case, the ejecting arrangement 24 then only has ten effectively ejecting stops 34. All of the parts shown in these two figures correspond to the parts described further above and shown in FIGS. 1 to 3. Therefore, they are only mentioned again where necessary for an understanding of FIGS. 4 and 5. The paddle wheels 14, of which only one is visible, are seated in a rotationally fixed manner on the shaft 10 and rotatably driven in the direction of rotation U at the speed n1. The two mutually aligned ejecting wheels 28, 30 rotate in arrow direction U about the diagrammatically indicated axis of rotation 26 at the speed n2, which is half the speed n1 of the paddle wheel 14. This has the consequence that in each case two pockets 18 are assigned a common stop 34. The imbricated formation S delivered onto the delivery conveyor 50 has in each case two printing products 36, which are deposited congruently one on top of the other and, seen in conveying direction F, in each case rest in an imbricated manner on the preceding pair of printing products 36. The conveying speed v1 of the delivery conveyor 50 corresponds to the circumferential speed v2 of the ejecting wheels 28, 30. The distance, denoted by B, between two successive stops 34 corresponds to the distance B, between the leading folds 36', seen in conveying direction F, of the printing products 36 arranged in imbricated formation S.

The apparatus represented in FIGS. 1 to 5 for the delivery of printing products 36 operates in the mode shown in FIG. 1 as follows: a printing product 36 is inserted with its fold 36' ahead into each pocket 18 of the paddle wheel 14 in a known way from above and thereby makes contact with the base 22 of the respective pocket 18 with its fold 36'. During the course of further rotation of the paddle wheel 14, due to the different speed between the base 22 and the stop 34, the printing product 36 runs with its fold 36' against a stop 34 of the one paddle wheel 28 or 30 and is thereby retarded to the speed of the stop 34. At the same time, the printing product 36 is clamped and held in the region of the fold 36' between the paddle 20 bounding the pocket 18 from the outside, seen in radial direction, and a flat running flank part 38'' of the other ejecting wheel 30 or 28 respectively. During the course of further rotation, the respective printing product 36 is pushed rearward in the pocket 18 counter to the arrow direction U in a way corresponding to the relative speed between the paddle wheel 14 and the ejecting wheels 28, 30. The printing product 36 thereby makes contact, with its rear region, seen in direction of circulation U, with the delivery conveyor 50 or the printing product 36 last deposited thereupon and is then finally released in the region of the fold 36' from the paddle wheel 14 by the free end 20' of the respective paddle 20 running past the stop 34.

The paddles 20 and flank parts 38'' are in each case at an acute angle to each other in the region in which the respective stops 34 effectively eject, and thus firmly hold the corresponding printing products 36 in wedge form.

In order to ensure undisturbed retarding and secure holding-firm of thick printing products 36 of varying thickness, the rotational position of the bearing arrangement 32 can then be set by means of the linkage 48.

Since the conveying speed v1 of the delivery conveyor 50 corresponds to the circumferential speed v2 of the ejecting wheels 28, 30, there is no relative displacement between the printing products 36 already delivered and the printing product 36 to be delivered next. This results in an undisturbed imbricated formation with constant distance A'. Thus, according to FIG. 1, each printing product 36 is ejected individually from the respective pocket 18 by a stop 34.

The apparatus represented in FIGS. 1 to 5 operates in the mode according to FIGS. 4 and 5 as follows: the ejecting arrangement 24 then has the same number of effectively ejecting stops 34 as the paddle wheel 14 has pockets 18, the ejecting wheels 28, 30 rotating at half-speed n2 in relation to the paddle wheel 14. This has the consequence that each stop 34 is responsible for ejecting two printing products 36 inserted into adjacent pockets 18. The printing product 36 inserted into the respectively leading pocket 18, in arrow direction U, makes contact with the respective base 22 and, due to the relative speed between the base 22 and the respective stop 34, runs onto the latter, is retarded and pushed rearward in the pocket 18 counter to the arrow direction U. The printing product 36 inserted into the next following pocket 18, seen in arrow direction U, likewise makes contact with the respective base 22 and runs onto the same stop 34 as the printing product 36 inserted into the preceding pocket 18. The printing product 36 inserted into the rear pocket is clamped and held between the paddle 20 bounding the respective pocket 18 on the outside in radial direction and the flank part 38'. Thus, two printing products 36 bear with their fold 36' against the same stop 34. During the course of further rotation, the printing product 36 arranged in the respectively preceding, outer pocket 18 is ejected and released from the pocket 18 first, the said product being deposited onto the delivery conveyor 50 in imbricated formation S with a distance B' with respect to the already delivered printing products 36 (cf. FIG. 4). Upon further rotation of the paddle wheel 14, the printing product 36 arranged in the following pocket 18 is then also ejected and released from the paddle wheel 14. Since the conveying speed v1 of the delivery conveyor 50 is the same as the circumferential speed v2 of the ejecting wheels 28, 30, this printing product 36 then comes to rest congruently on the already deposited printing product 36, as is represented in FIG. 5. In the same way, the next two printing products 36 are then delivered in an imbricated manner onto the already deposited printing products 36.

It must be noted that, for changing over from one mode to the other, all that is necessary is to turn the two ejecting wheels 28, 30 in opposite directions by half a division of the stops 34. There is no need to change the relative speeds between the paddle wheel 14 and ejecting wheels 28, 30 nor to alter the conveying speed v1 of the delivery conveyor 50. All that happens is that the distance A' or B' between the folds 36' of the printing products 36 is doubled or halved, respectively. If the delivery speed is changed, consequently there is neither a change in the imbrication spacing A', B' nor a phase shift between the imbricated formation S and the delivery conveyor 50.

The apparatus shown in FIGS. 6 to 11 in a view and partly simplified and in FIG. 12 in side view in the direction of the arrow XII of FIG. 6 has three paddle wheels 74 which are seated in a rotationally fixed manner on a shaft 70 and spaced apart in the direction of the axis 72 of the shaft 70. In FIGS. 6 to 11, the paddle wheels 74 are only partly shown. The delivery apparatus is described in detail with respect to FIGS. 6 and 12; in FIGS. 7 to 11, only those reference symbols which are necessary for an understanding are specified. The shaft 70 is mounted freely rotatably in fixed-in-place bearings 76 and driven in direction of rotation U at the speed n1. Each paddle wheel 74 has ten pockets 78, which are open rearward seen in direction of rotation U and are bounded, seen in radial direction, by paddles 80 and in their leading end by a base 82. The rear free end of the paddles 80 is denoted by 80' (FIG. 6). An ejecting arrangement, denoted by 84, has between the paddle wheels 74 in each case a first ejecting wheel 88, driven in rotation about the axis of rotation 86 (cf. FIG. 12 in particular). The first ejecting wheel 88 is designed in the form of a disk ring and mounted freely rotatably on a bearing arrangement indicated by dashed lines in FIG. 12. The bearing arrangement 92 is of an identical design to the bearing arrangement 32 shown in FIG. 3 and discussed in detail further above, the first ejecting wheel 88 in the region of the bearing arrangement 92 being of the same design as the ejecting wheel 30 according to FIG. 3. The first ejecting wheel 88 is driven at a speed n2, which is half the speed n1 of the paddle wheel 74, via a pinion which is seated in a rotationally fixed manner on the shaft 70 and meshes with an internal toothing on the first ejecting wheel 88.

The first ejecting wheel 88 is designed in saw-toothed form on its circumference, the twenty steep flanks, trailing flanks seen in direction of rotation U, serving as stops 94 for the printing products 96 inserted into the pockets 78 of the paddle wheels 74. The flat flanks, leading in relation to the stops 94 in arrow direction U, are denoted by 98. By means of a linkage 100, shown in FIG. 12, the eccentric bearing arrangement 92 can be set in its position of rotation in relation to the axis 72 in order to hold in a known way printing products 96 of varying thickness between the paddles 80 and the flanks 98.

The ejecting arrangement 84 has in the region between the shaft 70 and the bottom-lying radial end region of the first ejecting wheel 88 in each case a second ejecting wheel 102 outside, seen in the direction of the axis 72, the two outer paddle wheels 74. As indicated in dot-dashed lines in FIG. 12, it would also be conceivable for both second ejecting wheels 102 or two additional second ejecting wheels to be provided in the region between the first ejecting wheels 88 and the central paddle wheel 74. The second ejecting wheels 102 are mounted freely rotatably on a holder 104, only diagrammatically indicated in FIG. 12, and can be driven by means of a diagrammatically indicated drive element 106, likewise in direction of rotation U at the speed n3, the speed n3 being equal to the speed n2 of the first ejecting wheel 88. This means that the second ejecting wheels 102 are driven at half-speed in relation to the paddle wheels 74. The drive element 106 is preferably a chain drive, which in each case effectively connects the second ejecting wheel 102 to the shaft 70 with a gear reduction of 2:1.

The second ejecting wheel 102 is designed in saw-toothed form on its circumference, the steep flanks, trailing flanks seen in direction of rotation U, being designed as stops 108 for the leading fold 96' of the printing products 96. The number of stops 108 coincides with the number of pockets 78 of each paddle wheel 74. Since the speed n3 of the second ejecting wheel 102 is then half the speed n1 of the paddle wheels 74, a single stop 108 of the second ejecting wheel 102 in each case meets two pockets 78.

The second ejecting wheels 102 can be brought by means of the holder 104 out of the area of effect on the printing products 96, for example by swiveling in arrow direction B about the axis 72. By swiveling back counter to arrow direction B into the position shown in the figures, the second ejecting wheel 102 in turn becomes effectively ejecting.

A delivery conveyor 110, for example a belt conveyor, which is driven in conveying direction F, is provided underneath the paddle wheels 74 and the ejecting arrangement 84. With effectively ejecting second ejecting wheel 102, the conveying speed v1 o the delivery conveyor 110 corresponds to the circumferential speed v2 of the second ejecting wheel 102. If, on the other hand, the second ejecting wheel 102 is swiveled out of the area of effect on the printing products 96, the delivery conveyor 110 is driven at a conveying speed v1 which corresponds to the speed of rotation v3 of the first ejecting wheel 88.

A deflecting element 114 for the open trailing edges of the printing products 96, opposite the fold 96'' and denoted by 96'', runs from a feed area 112 of the printing products 96 into the region above the delivery conveyor 110.

On the delivery conveyor 110, the printing products 96 deposited thereupon lie in an imbricated formation S, two printing products 96 lying congruently one on top of the other in each case resting in an imbricated manner on the preceding pair of printing products 96. The distance C' between the leading folds 96' of two respectively adjacent pairs of printing products 96 corresponds to the distance C between the stops 108 of the second ejecting wheel 102. As still to be explained further below, if the second ejecting wheel 102 is swiveled out of the area of effect onto the printing products 96, the printing products 96 are deposited onto the delivery conveyor 110 in an imbricated formation S, in which each printing product 96 in each case rests in an imbricated manner on the preceding one. The distance between the folds 96' of the printing products 96 thus deposited in imbricated formation corresponds to the distance denoted by C'' between the stops 94 of the first ejecting wheel 88. The second ejecting wheel 102 is, for example, approximately half as large in diameter as the first ejecting wheel 88 and likewise has half as many stops 108 as the first ejecting wheel 88 has stops 94. Therefore, the distance C corresponds to the distance C''. This means that, in each imbricated formation S formed, the distance between the folds 96' always remains unchanged, irrespective of whether each printing product 96 is then deposited in an imbricated manner onto the preceding one or whether two printing products 96' lying one on top of the other are in each case deposited in an imbricated manner onto the preceding pair of printing products 96. In FIGS. 6 to 11, the functional principle of the embodiment of the delivery apparatus shown in FIGS. 6 and 12 is represented at six different phases of a working cycle.

Figure 7:
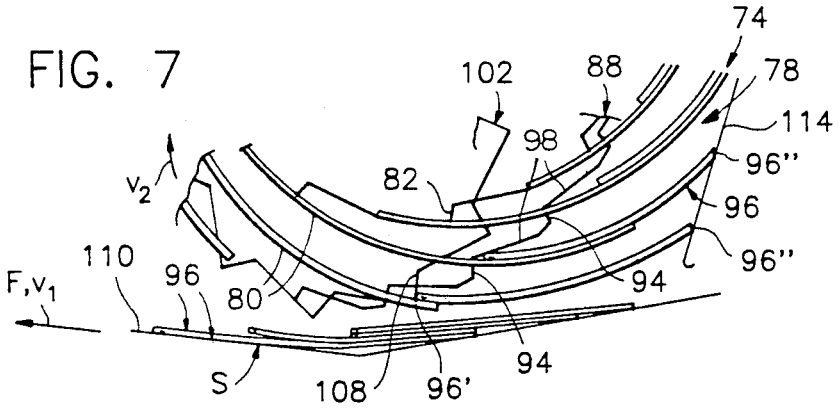
Figure 8:
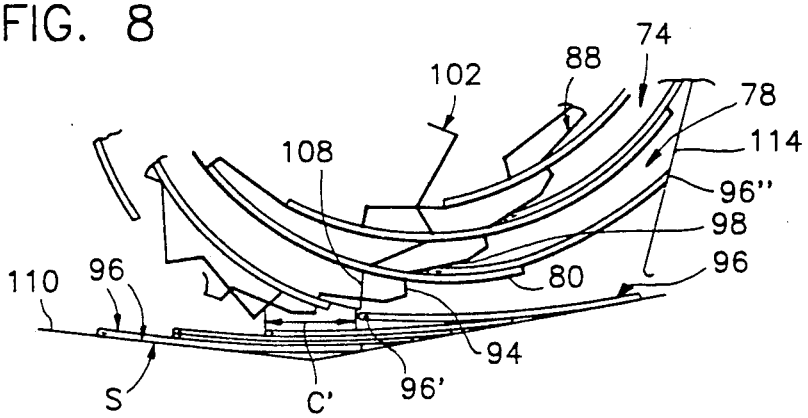
Figure 9:
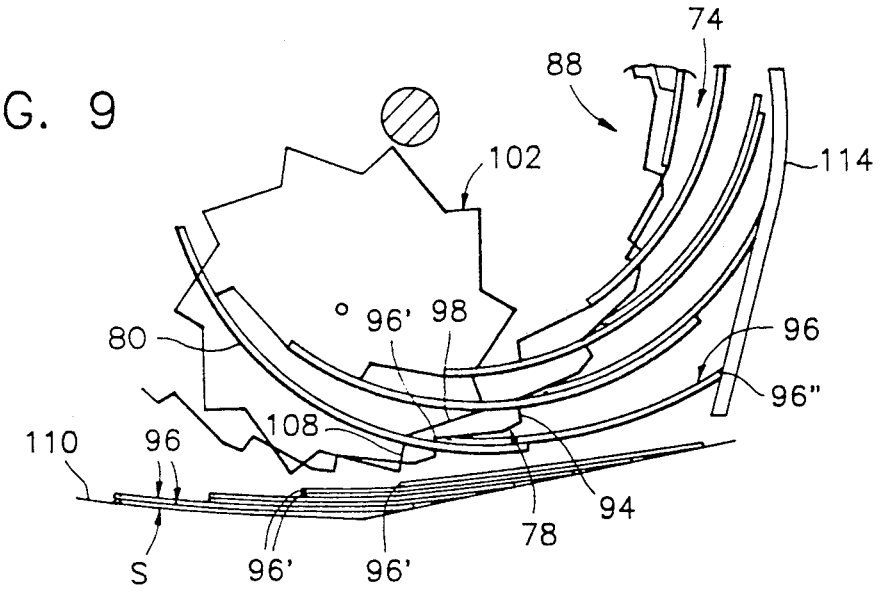

In the feed area 112, a printing product 96 is in each case inserted with its fold 96' ahead into each pocket 78. The fold 96' thereby makes contact with the base 82, as a result of which the printing product 96 is retarded to the speed of the base 82. During the course of further rotation of the paddle wheels 74, due to the relative speed between the base 82 and the stops 94 of the first ejecting wheel 88, the printing product 96 runs onto a stop 94. The printing product 96 is thereby clamped in the region of the fold 96' by the respective flank 98 and the paddle 80 bounding the pocket 78 on the outside in radial direction and is successively ejected from the pocket 78 counter to the direction of rotation U. The trailing edge 96'' thereby makes contact with the deflecting element 114. In the course of further rotation of the paddle wheels 74, due to the relative speed between the stops 94 of the first ejecting wheel 88 and the stops 108 of the second ejecting wheel 102, the printing product 96 hits a stop 108, as is shown in FIG. 7. Then, the printing product 96 is ejected from the pocket 78 at the relative speed between the paddle wheels 74 and the respective stop 108, as FIG. 7 shows. The trailing edge 96'' always continues to slide thereby along the deflecting element 114. Shortly thereafter, the respective paddle 80 underneath the fold 96' runs away, as a result of which the printing product 96 is deposited onto the imbricated formation S. Since the conveying speed v1 of the delivery conveyor 110 corresponds to the circumferential speed v2 of the second ejecting wheel 102, there is no relative displacement, seen in conveying direction F, between the printing products 96 to be deposited and printing products 96 already deposited. As a result, the formation of an undisturbed imbricated formation S is ensured, in which the distance C' corresponds to the distance C between the stops 108 of the second ejecting wheel 102 (cf. FIG. 6 and 8). The next following printing product 96, seen in arrow direction U, is likewise held in the region of the fold 96' between the respective paddle 80 and the respective flank 98 of the first ejecting wheel 88 and bears against the stop 94, as a result of which the said product is ejected from the pocket 78 owing to the relative speed between the first ejecting wheel 88 and the paddle wheels 74 (FIGS. 9 and 10). The trailing edge 96" thereby slides off the deflecting element 114 and the printing product 96 is deposited with its trailing region onto the printing product 96 previously deposited onto the imbricated formation S. During this depositing, the printing product 96 to be deposited runs with its fold 96' onto the same stop 108 of the second ejecting wheel 102, with which the previously deposited printing product 96 already made contact (FIG. 11). The printing product 96 still held with the region of its fold 96' in the pocket 78 thereby comes to rest with its trailing edge 96" precisely over the trailing edge 96" of the previously deposited printing product 96. Shortly thereafter, due to the relative speed between the paddle wheels 74 and the stop 108 of the second ejecting wheel 102, the fold 96' is also released, as a result of which the printing product 96 comes to rest congruently on the previously deposited printing product 96. It must be noted that each printing product 96 comes to rest in the same way between the respective paddle 80 and the corresponding flank 98 of the first ejecting wheel 88 and is held by the latter.

By swiveling the second ejecting wheel 102 in arrow direction B (FIG. 6) out of the area of effect on the printing products 96, the delivery apparatus operates identically to the apparatus known for example, from European Parent Specification No. 0,059,873 and the corresponding U.S. Pat. No. 4,434,979. The delivery conveyor 110 is then driven in a way corresponding to the circumferential speed v3 of the first ejecting wheel 88. Each printing product 96 inserted in the feed area 112 into a pocket 78 of the paddle wheels 74 makes contact, with its fold 96', with the base 82. Due to the relative speed between the base 82 and the respective stop 94 of the first ejecting wheel 88, the printing product 96 runs onto the said stop 94. The printing product 96 is thereby held in the region of its leading fold 96' by the flank 98 and the paddle 80. In the course of further rotation of the paddle wheels 78 and of the first ejecting wheel 88, the printing product 96 is pushed out of the pocket 78 counter to the direction of rotation U, the trailing edge 96" of the printing product 96 making contact with the deflecting element 114 and sliding along the latter to the delivery conveyor 110. The leading fold 96' then does not run onto a stop 108 of the second ejecting wheel 102 but is ejected and released from the pocket 78 by the first ejecting wheel 88. This then has the consequence that each printing product 96 is deposited in an imbricated manner onto the preceding printing product 96. The distance between the folds 96' of the deposited printing products 96 in this case corresponds to the distance C" between the stops 94 of the first ejecting wheel 88.

In the case of an embodiment similar to the apparatus shown in FIGS. 1 to 4, it is conceivable to provide only a single ejecting wheel and arrange every second stop adjustably on it. It would thus be possible to provide every second stop in such a way that it can be displaced or swiveled in radial direction and to bring them into and out of the area of effect on the printing products by means of a corresponding control device. It goes without saying that the number of paddles of a paddle wheel and the number of stops can also be chosen differently to the exemplary embodiments represented above. It would also be conceivable to adapt the number of pockets and stops and the corresponding speeds in such a way that more than two printing products can in each case be deposited one on top of the other.

I claim:

1. An apparatus for the delivery of printing products in a regular imbricated formation upon a belt conveyor, having a rotatably driven paddle wheel of a printing machine and having a wheel-shaped ejecting arrangement, which is mounted eccentrically with respect to the paddle wheel, can be driven in the same direction of rotation as and at a lower circumferential speed than the paddle wheel and has arranged on its circumference stops for ejecting the printing products at predetermined intervals from pockets of the paddle wheel in which they are inserted and, owing to the relative speed between the stops and the pockets, initially run onto the stops, characterized in that the number of effectively ejecting stops is variable, wherein said apparatus comprises means for enabling the printing products arranged in two or more consecutively occupied pockets to run onto a common stop and to be ejected by said common stop from the paddle wheel one on top of the other.

2. An apparatus as claimed in claim 1, wherein the number of effectively ejecting stops can be halved.

3. An apparatus for the delivery of printing products in a regular imbricated formation upon a belt conveyor, having a rotatably driven paddle wheel of a printing machine and having a wheel-shaped ejecting arrangement, which is mounted eccentrically with respect to the paddle wheel, can be driven in the same direction of rotation as and at a lower circumferential speed than the paddle wheel and has arranged on its circumference stops for ejecting the printing products at predetermined intervals from pockets of the paddle wheel in which they are inserted and, owing to the relative speed between the stops and the pockets, initially run onto the stops, characterized in that the number of effectively ejecting stops is variable, wherein the ejecting arrangement has two coaxially mounted ejecting wheels with the same number of stops, which can be adjusted with respect to each other by half a stop division out of a position in which, seen in the circumferential direction, there lies centrally between two stops of the one stop wheel in each case a stop of the other stop wheel, and wherein the number of effectively ejecting stops can be halved.

4. An apparatus as claimed in claim 3, wherein the ejecting wheels are of an annular design, encompassing the shaft of the paddle wheel, and are rotatably mounted on a bearing arrangement, the bearing arrangement being common for both ejecting wheels.

5. An apparatus as claimed in claim 4, wherein the bearing arrangement is mounted on the shaft of the paddle wheel and is variable in its position in the circumferential direction of the shaft and at least one ejecting wheel has an internal toothing, which meshes with a gear wheel connected in a rotationally fixed manner to the shaft.

6. An apparatus as claimed in claim 3, wherein the number of stops on each ejecting wheel corresponds to the number of pockets of the paddle wheel and the ejecting wheels can be driven at half number of revolutions in relation to the paddle wheel.

7. An apparatus as claimed in claim 3, wherein a delivery conveyor is provided underneath the paddle wheel, the conveying direction of which conveyor corresponds to the direction of rotation of the paddle wheel and the conveying speed of the said conveyor corresponds essentially to the circumferential speed for the effectively ejecting ejecting wheel upon depositing of the printing products.

8. An apparatus as claimed in claim 3, wherein the ejecting wheels are of an annular design, encompassing the shaft of the paddle wheel and are rotatably mounted on a bearing arrangement.

9. An apparatus as claimed in claim 8, wherein the bearing arrangement is mounted on the shaft of the paddle wheel and at least one ejecting wheel has an internal toothing which meshes with a gear wheel connected in a rotationally fixed manner to the shaft.

10. An apparatus for the delivery of printing products in a regular imbricated formation upon a belt conveyor, having a rotatably driven paddle wheel of a printing machine and having a wheel-shaped ejecting arrangement, which is mounted eccentrically with respect to the paddle wheel, can be driven in the same direction of rotation as and at a lower circumferential speed than the paddle wheel and has arranged on its circumference stops for ejecting the printing products at predetermined intervals from pockets of the paddle wheel in which they are inserted and, owing to the relative speed between the stops and the pockets, initially run onto the stops, characterized in that the number of effectively ejecting stops is variable, wherein the ejecting arrangement has a first ejecting wheel, mounted eccentrically in relation to the paddle wheel and encompassing the shaft of the paddle wheel, and a second ejecting wheel, which is eccentrically mounted differently, can be driven at lower circumferential speed, has a smaller diameter and a smaller number of stops than the first ejecting wheel, is arranged outside the shaft and can, according to choice, be brought into and out of effect on the printing products.

11. An apparatus as claimed in claim 10, wherein the first ejecting wheel has twice as many and the second wheel has the same number of stops as the paddle wheel has pockets, and both ejecting wheels can be driven at half number of revolutions in relation to the paddle wheel.

* * * * *